US005647806A

United States Patent [19]

McDevitt

[11] Patent Number: 5,647,806

[45] Date of Patent: Jul. 15, 1997

[54] DUAL SHAFT GOLF CLUB

[76] Inventor: Robert F. McDevitt, 25 Diana Rd. 551, Ogden Dunes, Portage, Ind. 46368

[21] Appl. No.: 636,030

[22] Filed: Apr. 22, 1996

[51] Int. Cl.[6] ..... A63B 53/02; A63B 53/04

[52] U.S. Cl. ..... 473/252; 473/300; 473/313; 473/314; 473/316

[58] Field of Search ..... 473/294, 316, 473/313, 252, 304, 305, 238, 226, 201, 300, 314, 251

[56] References Cited

U.S. PATENT DOCUMENTS

| | | | |
|---|---|---|---|
| 3,529,826 | 9/1970 | Hulyk . | |
| 4,215,860 | 8/1980 | Nakamatsu . | |
| 4,754,978 | 7/1988 | Dworacek | 473/294 |
| 4,795,153 | 1/1989 | Thomas . | |
| 4,951,949 | 8/1990 | Kastenhuber | 473/313 |
| 5,037,103 | 8/1991 | Williams et al. . | |
| 5,209,475 | 5/1993 | Loman . | |
| 5,308,073 | 5/1994 | McKoon et al. . | |
| 5,505,447 | 4/1996 | Mockovak | 473/313 |
| 5,553,858 | 9/1996 | McKoon | 473/294 |

FOREIGN PATENT DOCUMENTS

| | | | |
|---|---|---|---|
| WO84/03447 | 9/1984 | WIPO | 273/81 B |

*Primary Examiner*—Sebastiano Passaniti

*Attorney, Agent, or Firm*—Marshall, O'Toole, Gerstein, Murray & Borun

[57] ABSTRACT

A golf club comprises a handle and a head having a planar face, a toe portion, a heel portion, and a center of percussion between the toe and heel portions. A dual shaft extends from the handle, comprising a toe shaft and a heel shaft joined respectively to the toe portion and the heel portion of the head. The toe and heel shafts extend into and define the handle. The toe shaft overlies the heel shaft within the handle to define a handle plane which is parallel to the plane of the club head face to give a user an indication through the grip of the orientation of the club face. The toe shaft and the heel shaft diverge at their junction with the handle and extend to the head without interconnection therebetween to mutually independently control the torque applied to the head when a golf ball is impacted off the center of percussion.

14 Claims, 1 Drawing Sheet

DUAL SHAFT GOLF CLUB

FIELD OF THE INVENTION

This invention relates to golf clubs, and particularly to an improved golf club having a broader "sweet spot", and means for providing a visual and tactile reference to the user of the plane of the club face.

BACKGROUND OF THE INVENTION

Conventional golf clubs have a single shaft, typically joined to the club head at the heel of the club head. Impacting of a ball by the club head offset from its center of percussion will rotationally deflect the club head. The resulting torque impulse on the club shaft is resisted by the stiffness of the club shaft and the friction resistance of the grip to turning in the hands of the player. However, the energy expended to twist the shaft, and any friction losses in the grip, will reduce the return velocity of the ball. Deflection of the club head may affect the intended return path of the ball.

It is important in a golf putting stroke for the player to have a strong visual perception of the orientation of the club head face at impact with the ball. The player should also be able to relate the orientation of the hand grip to the orientation of the face of the club head. Conventional single shaft clubs with grips having a circular cross-section do not provide the player with either a strong visual or a tactile indication of the orientation of the club head face.

Joseph B. Thomas U.S. Pat. No. 4,795,153 illustrates a golf putter in which a portion of the shaft engaging the club head is bifurcated, a pair of narrowly spaced parallel tines being affixed to the club head at substantially 90° to the club head axis and on opposed sides of the club head center of percussion. The club handle is shown as being parallel to the bifurcated portion of the shaft and is also therefore also oriented at 90° to the club head axis. An angled shaft portion interconnects the bifurcated shaft portion and the handle portion of the club. The parallel tines of the bifurcated shaft portion define a plane which includes the axis of the club head, but the orientation of that plane is not conveyed to the player through the grip.

SUMMARY OF THE INVENTION

In accordance with the principles of the present invention, there is provided an improved golf club including a novel shaft extending between the handle and the club head. According to one aspect of the invention, the shaft comprises a toe shaft and a heel shaft joined respectively to the toe portion and heel portion of the club head. The toe shaft and the heel shaft diverge at their junction with the handle and extend to the head without interconnection therebetween to mutually independently control the torque applied to the head when a golf ball is impacted off the center of percussion. In accordance with another aspect of the invention, the club head has a planar face, and the toe shaft overlies the heel shaft within the handle to define a handle plane which is parallel to the plane of the club head face to give a user an indication through the grip of the orientation of the club face.

By the present invention, the club head experiences a reduced rotational deflection when a golf ball is struck offset from the center of percussion of the club head. Further, the player is given a strong visual perception, as well as a tactile indication at the grip, of the orientation of the club head face to permit improved control of the club head face at impact with the ball.

BRIEF DESCRIPTION OF THE DRAWINGS

The features of this invention which are believed to be novel are set forth with particularity in the appended claims. The invention may be best understood by reference to the following description taken in conjunction with the accompanying drawings in which like reference numerals identify like elements in the several figures and in which:

DETAILED DESCRIPTION

Figure 1:
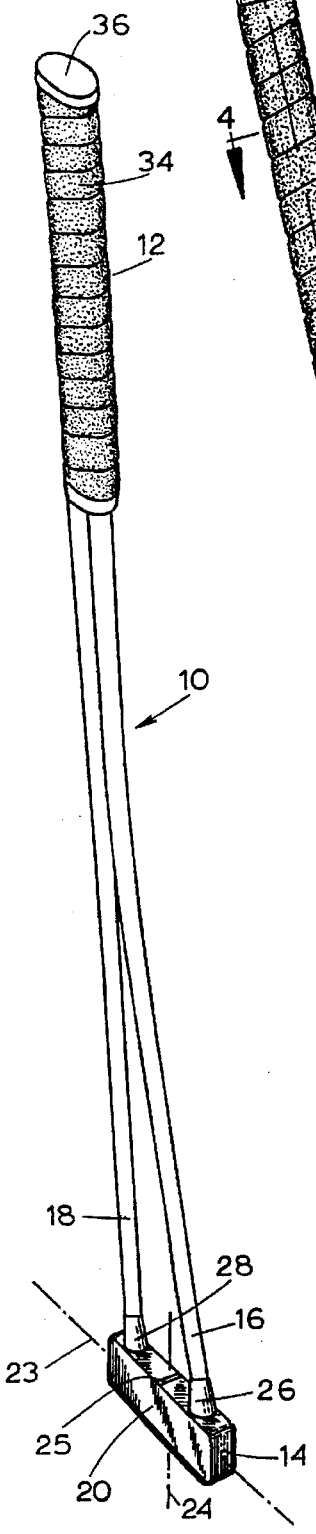
FIG. 1 is a perspective view of a golf club constructed according to the teachings of the present invention.
Figure 2:
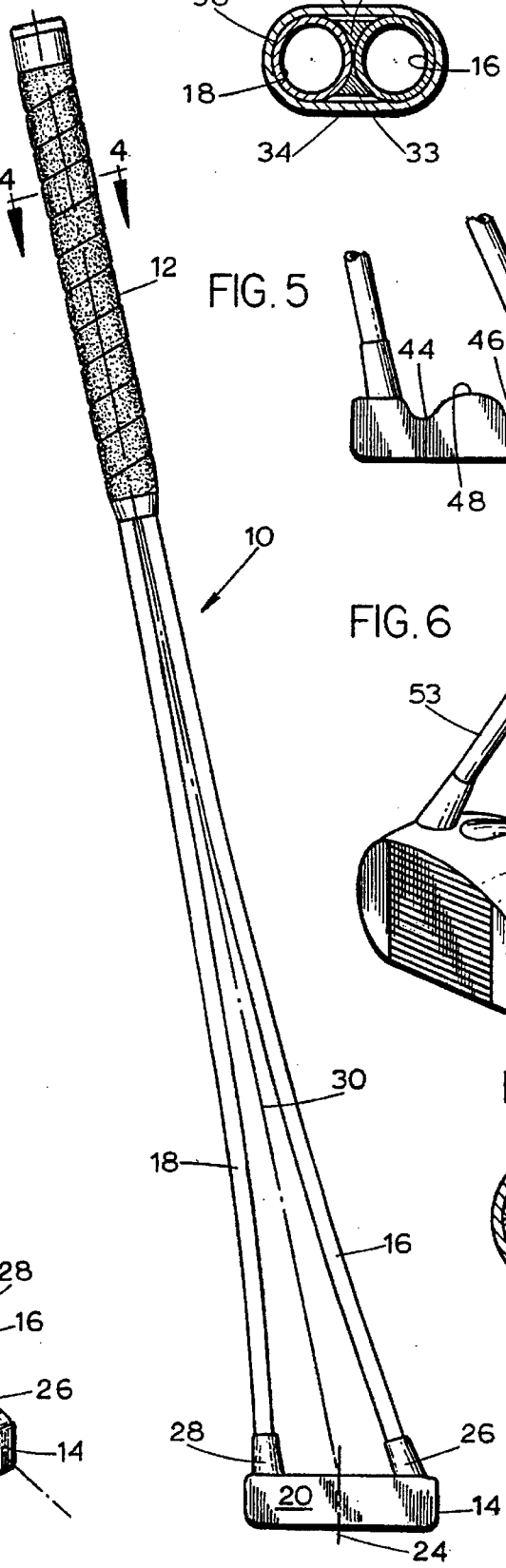
FIG. 2 is a side elevation view of the golf club illustrated in FIG. 1.

Referring to FIGS. 1–4 of the drawings, there is illustrated a golf club 10 having a handle 12 and a head 14; the head may be composed, for example, of 1018 grade cold-rolled steel.

A shaft extending between the handle 12 and the club head 14 comprises a toe shaft 16 and a heel shaft 18. The toe shaft 16 and the heel shaft 18 may each be composed, for example of light weight tempered steel or graphite tubing.

The club head 14 has opposed faces 20, 22 and an axis 23 running longitudinally through the body of the club head 14. The head has a center of percussion in the center of the head; a fiducial mark 25 in the center of the club head 14 lies on a center of percussion axis passing through the center of percussion of the club head 14.

The toe shaft 16 is joined to the club head 14 at a toe shaft joint 26 which may, for example, comprise a drilled hole in which toe shaft 16 is anchored with epoxy or other cement.

The heel shaft 18 is joined to the club head 14 at a heel shaft joint 28. The heel shaft joint 28 may be structured like the toe shaft joint 26. The joints 26, 28 are equidistant from the center of percussion axis 24.

A shaft axis 30, comprising an extension of the axis of the handle 12, intersects the center of the golf club. In a putter the shaft axis 30 may be oriented, for example, at approximately 72.5° to the club head axis 24.

Figure 4:
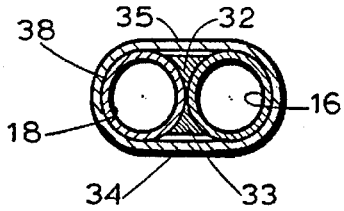
FIG. 4 is a section view taken along lines 4—4 in FIG. 2.

Referring now to FIG. 4, the toe shaft 16 and the heel shaft 18 lie juxtaposed within the handle 12. A handle fill 32, 33 between the shafts 16, 18 may be composed, for example, of silicone rubber, expanded rubber or plastic. The shafts 16, 18 and the fill 32, 34 are covered with a wound wrap 38. An end cap 36 closes the open ends of the shafts 16 and 18.

One of the most common problems plaguing golfers, particularly amateur golfers, is an inability to strike the ball on the center of percussion of the club head. Any strike at a point on the club head face offset from the center of percussion will cause the club head to rotationally deflect. The twisting action of the club face and club shaft stores potential energy in the club shaft. This stored energy which is derived from the kinetic energy in the moving club head and shaft is not released until after the ball leaves the club face and is therefore wasted. This wasted kinetic energy, and any friction energy losses in the grip, are not available to be imparted to the ball, resulting in a reduced ball velocity. Also, the rotational deflection of the club head caused by on off-center strike may cause the ball to be propelled in an unintended direction.

In accordance with the teachings of the present invention, a golf club is provided in which the shaft takes the form of a heel shaft and a toe shaft, the heel shaft being secured at the extreme heel of the club head and the toe shaft being secured at the extreme toe end of the club head. In a preferred embodiment (FIGS. 1–4), the junction points or joints 26 and 28 are separated as widely as possible from the center of percussion axis 24 of the club head, 14.

When a ball is struck at a point offset from the center of percussion axis 24, a torque impulse will be imparted to the club head. However, rather than being resisted by a single shaft joined at the heel of the club as is conventional, in accordance with this invention any torque imposed on one of the two shafts is counteracted by an opposing torque on the other shaft. The result is a diminished rotational deflection of the club face and an enlarged "sweet spot".

Not only is the magnitude of the deflection torque reduced, but, due to more rapid damping of the vibrations created, an off-center strike will produce less club vibration than is produced in a conventional single shaft club.

In the application of the present invention to a putter, as shown in FIGS. 1–4, the planar configuration of the golf club 10 provides improved visual feedback to the player of the plane of the club head faces of the club head 14.

The heel shaft 18, the toe shaft 16, and the club head 14 form a triangular structure which defines a plane parallel to the club head faces 20, 22. This large triangular structure creates a strong visual reference for the player, permitting improved control of the club head face at impact.

In accordance with another aspect of the present invention, the aforesaid plane defined by the toe shaft, heel shaft and club head is carried into the handle. The toe shaft 16 and the heel shaft 18 are overlaid in the handle 12, forming a plane which is coincident with the plane formed by the toe shaft 16, heel shaft 18, and club head 14.

Thus, the strong visual plane of reference defined by the shafts 16 and 18 and the club head 14 is enhanced by the tactile reinforcement imparted to the player through the grip. The flats 34, 35 defined on the sides of the grip 12 will abut the heels of the hands of the player. He or she will know from the "feel" of the grip the direction in which the active club face is oriented.

Thus, the combination of the planar flats 34, 35 on the handle and the strong visual reference created by the shafts 16 and 18 and club head 14 will permit greater control over the orientation of the club head face during putting.

Further, the flats 34, 35 will resist twisting of the club shaft if the club head impacts the ball off-center.

It will be seen that at the joint 26 of the toe shaft 16 with the club head 14, because of the bowing of the toe shaft, the toe shaft 16 will form an angle with the club head axis 23 which is slightly less than the angle formed by the shaft axis 30 with the club head axis 23. The shaft axis may in a putter be approximately 72.5°, for example.

Conversely, at the joint 28 formed by the heel shaft 18 with the club head axis 23, the heel shaft 18 will form an angle with the club head axis 23 which is slightly greater than the angle formed by the shaft axis 30 with the club head axis 23.

By separating the joints 26, 28 as widely as possible from the center of percussion axis 24, substantially the entire active area of the club faces are between the joints 26, 28. By this expedient, the player is unable to strike the ball outside this active area between the joints 26 and 28 and thereby impart an unnecessarily large torque impulse on the club shaft.

It is believed that with the dual shaft teachings of the present invention, minimal twisting or torquing of the combined shafts will occur since the two individual shafts are anchored together at each end. They cannot therefore twist or torque upon impact but will tend to flex away from each other, causing a momentary lengthening of the overall shaft length. Upon recovery, it is believed that the shafts may provide an extra boost or kick to the ball, and that the club face may momentarily follow the ball for a longer period of time. This will be of greater significance in the case of a driver or iron, since much more force is used and greater flexing of the shafts will occur than with a putter. It is believed that the phenomenon just described may be enhanced if graphite rather steel shafts are employed.

Whereas a preferred embodiment of the invention is shown, it will be clear to those skilled in the art that the above example is illustrative only and that the principles of the invention may be employed in golf clubs of other designs and constructions. It is not necessary, for example, that the dual shafts take the form of individual tubings which are carried through the handle. In other modifications of the invention, shafts of other constructions may be employed, and the toe shaft and heel shaft may be joined at a point below the handle and a modified construction employed in the handle region. The toe shaft 16 and the heel shaft 18, rather than being cemented in drilled holes in the club head 14 may be forced over horns formed integrally with the club head. Rather than the handle covering comprising a wrap, a sleeve may instead be drawn over the handle's structural members.

The teachings of the invention may be employed with putter heads, driver heads and iron heads of many different types and constructions. Means other than shown may be employed for creating the desirable flats on the opposed sides of the putter handle.

Figure 5:
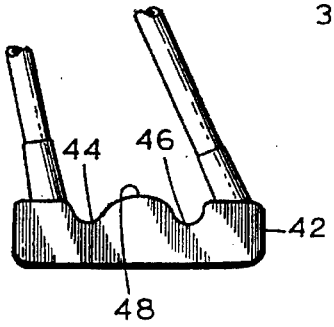
FIG. 5 illustrates an alternative embodiment of the invention.

An alternative embodiment of the invention is illustrated in FIG. 5 wherein recesses 44 and 46 are provided in a club head 42 to concentrate a greater portion of the club head mass in a central portion 48.

The Thomas U.S. Pat. No. 4,795,153 teaches joining the club shaft with the club head at 90°. The application of the club is thereby restricted to use as a putter. However, by the present invention the angle of shaft axis 30 is conventional, permitting the principles of the invention to be employed in golf clubs other than putters. For example, FIG. 6 depicts application of the present invention to a driver in which a driver head 52 is connected a toe shaft 53 and a heel shaft 54.

Figure 6:
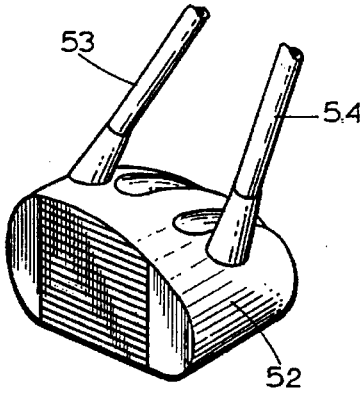
FIG. 6 illustrates another embodiment of the invention.
Figure 7:
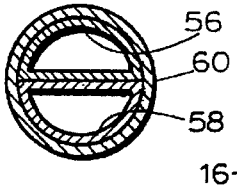
FIG. 7 is a section view corresponding to FIG. 4 of yet another embodiment of the invention.
Figure 3:
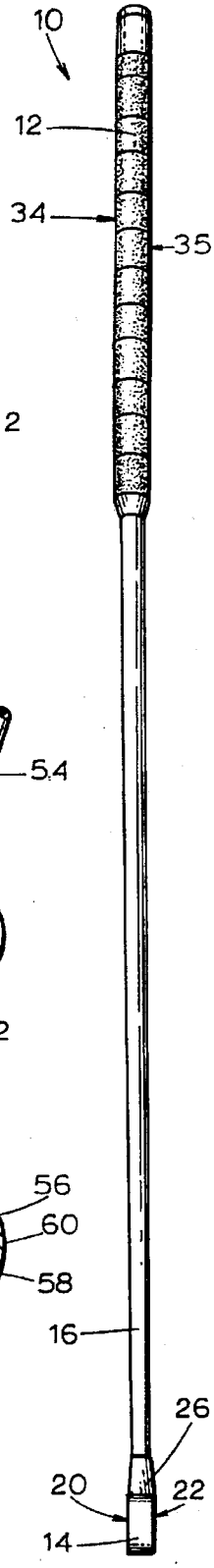
FIG. 3 is a front elevational view of the golf club of FIGS. 1–2.

In an application such as shown in FIG. 6 wherein the invention is employed in a club other than a putter, it may be desirable to have a handle which is round rather than one which defines a plane as described above. To that end, FIG. 7 illustrates one of many ways in which a handle with a round cross section may be constructed. In FIG. 7, a modified toe shaft 56 and heel shaft 58 are formed to have a half-moon cross-section such that when joined together, they will form a circular cross section. A wrap 60 which may be conventional is employed to cover the joined shafts 56, 58.

I claim:

1. A golf club comprising:

a handle;

a head having a toe portion and a heel portion and a center of percussion therebetween; and a dual shaft extending from said handle, comprising a toe shaft and a heel shaft joined respectively to said toe portion and said heel portion of said head, said toe shaft and said heel shaft diverging at their junction with said handle and extending to said head without interconnection therebetween to mutually independently control the torque applied to said head when a golf ball is impacted off said center of percussion.

2. The golf club defined by claim 1 wherein said toe shaft and said heel shaft are bowed away from each other between said handle and said head.

3. The golf club defined by claim 1 wherein said golf club is a putter.

4. The golf club defined by claim 1 wherein said golf club is a driver.

5. The golf club defined by claim 1 wherein said shafts extend into and define said handle.

6. The golf club defined by claim 5 wherein said club head has a planar face, and wherein said toe shaft overlies said heel shaft within said handle to define a handle plane which is parallel to the plane of said club head face to give a user an indication through the grip of the orientation of said club face.

7. A golf club comprising:

a handle;

a head having a planar face, and having toe portion and a heel portion and a center of percussion therebetween; and a dual shaft extending from said handle, comprising a toe shaft and a heel shaft joined respectively to said toe portion and said heel portion of said head and extending into and defining said handle, said toe shaft overlying said heel shaft within said handle to define a handle plane which is parallel to the plane of said club head face to give a user an indication through the grip of the orientation of said club face.

8. The golf club defined by claim 7 wherein said toe shaft and said heel shaft are bowed away from each other between said handle and said head.

9. The golf club defined by claim 7 wherein said golf club is a putter.

10. The golf club defined by claim 7 wherein said golf club is a driver.

11. A golf club comprising:

a handle;

a head having a planar face, and having a toe portion and a heel portion and a center of percussion therebetween; and a dual shaft extending from said handle, comprising a toe shaft and a heel shaft joined respectively to said toe portion and said heel portion of said head and extending into and defining said handle, said toe shaft overlying said heel shaft within said handle to define a handle plane which is parallel to the plane of said club head face to give a user an indication through the grip of the orientation of said club face, said toe shaft and said heel shaft diverging at their junction with said handle and extending to said head without interconnection therebetween to mutually independently control the torque applied to said head when a golf ball is impacted off said center of percussion.

12. The golf club defined by claim 11 wherein said toe shaft and said heel shaft are bowed away from each other between said handle and said head.

13. The golf club defined by claim 11 wherein said golf club is a putter.

14. The golf club defined by claim 11 wherein said golf club is a driver.

* * * * *

UNITED STATES PATENT AND TRADEMARK OFFICE

CERTIFICATE OF CORRECTION

PATENT NO. : 5,647,806

DATED : July 15, 1997

INVENTOR(S) : Robert F. McDevitt

It is certified that error appears in the above-identified patent and that said Letters Patent is hereby corrected as shown below:

Column 5

Claim 1, line 9, after "extending" insert --from said junction--; and

Claim 1, line 10, after "therebetween" insert --and spaced to form a generally triangular structure which defines a plane parallel to a club face portion of said head--.

Claim 7, line 9, after "handle" insert--said toe shaft and said heel shaft spaced along their lengths from said handle to said head to form a generally triangular structure which defines a place parallel to a club face portion of said head,--.

Claim 11, line 15, after "extending" insert--from said junction--; and

Claim 11, line 16, after "therebetween" insert--and spaced to form a generally triangular vstructure which defines a plane parallel to a club face portion of said head--.

Signed and Sealed this

Twenty-seventh Day of January, 1998

*Attest:*

Bruce Lehman

BRUCE LEHMAN

*Attesting Officer*

*Commissioner of Patents and Trademarks*